United States Patent [19]

Montefameglio et al.

[11] 4,383,952

[45] May 17, 1983

[54] CARBURETOR

[75] Inventors: Livio Montefameglio; Lorenzo Ciaccio; Guido Spiga, all of Bologna, Italy

[73] Assignee: Weber S.p.A., Milan, Italy

[21] Appl. No.: 337,421

[22] Filed: Jan. 6, 1982

[30] Foreign Application Priority Data

Mar. 24, 1981 [IT] Italy ..... 3376 A/81

[51] Int. Cl.[3] ..... F02M 5/02

[52] U.S. Cl. ..... 261/72 R; 261/DIG. 50

[58] Field of Search ..... 261/DIG. 50, 72 R

[56] References Cited

U.S. PATENT DOCUMENTS

| | | | |
|---|---|---|---|
| 2,718,387 | 9/1955 | Carlson et al. | 261/DIG. 50 |
| 2,757,914 | 8/1956 | Ball | 261/DIG. 50 |
| 2,828,952 | 4/1958 | Winkler | 261/DIG. 50 |
| 2,875,990 | 3/1959 | Gretz | 261/DIG. 50 |
| 2,914,307 | 11/1959 | Eickmann | 261/DIG. 50 |
| 3,372,912 | 3/1968 | Benmore | 261/DIG. 50 |
| 3,382,881 | 5/1968 | Charron | 261/DIG. 50 |
| 3,702,490 | 9/1965 | Sterner et al. | 261/DIG. 50 |
| 4,041,112 | 8/1977 | Nakamura et al. | 261/DIG. 50 |

*Primary Examiner*—Tim R. Miles

*Attorney, Agent, or Firm*—Murray Schaffer

[57] ABSTRACT

A carburetor for internal combustion engines of motor vehicles, having a suction conduit supplied with fuel from a float chamber in which the fuel is kept at a constant level by a needle valve actuated by a pair of floats. The float chamber has vertical side walls and the outer surfaces of the floats, particularly those facing the walls of the float chamber, are also vertical. A main jet is located on a vertical line passing through the center of gravity of a plane figure defined by sectioning a horizontal plane by a spatial figure defined between the inner walls of the float chamber and the outer surfaces of the floats. The main jet is supported by a columnar structure having vertical walls, suspended from the cover of the carburetor and accommodating the main and idling circuits of the carburetor. The planes of the level of the fuel in the float chamber section the floats along figures whose static moments relative to the fulcrum of the needle valve closing lever are substantially the same as the inclination of the carburetor relative to the horizontal plane varies.

3 Claims, 5 Drawing Figures

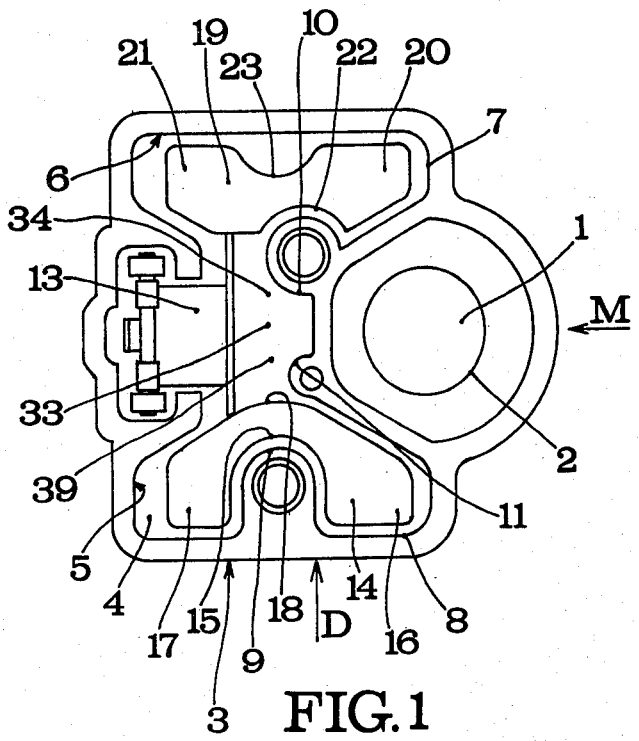
FIG. 1
FIG. 2
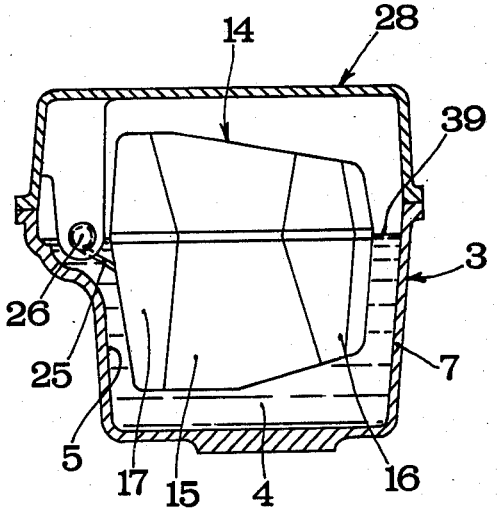

CARBURETOR

BACKGROUND OF THE INVENTION

This invention relates to carburetors for internal combustion engines and more particularly to a carburetor float chamber in which the fuel is kept at a constant level by a needle valve actuated by float members.

In present carburetor production technology it has not been possible to design a float chamber which without particular efforts could be inserted in a great variety of carburetors produced by modern industry to reduce design and test costs. In fact, the carburetors which are at present produced cannot be simply mounted on any engine irrespective of its orientation on the vehicle because the arrangement of the throttle valve relative to the main conduit of the carburetor and the arrangement of the float chamber relative to the throttle valve and the main conduit is selected according to strictly observed criteria to obtain an appropriate distribution of the fuel mixture over the various cylinders of the engine, particularly in the idling and speeding up steps, and ensure proper feeding of the engine in any position of the vehicle. So it would not be advisable to feed an engine arranged transversely of the vehicle by a carburetor designed to be mounted on an engine arranged longitudinally of the vehicle. Vice versa, a longitudinally mounted engine cannot be appropriately fed by a carburetor designed for feeding a transversely mounted engine and finally a carburetor designed for a passenger car is unsuitable for mounting on a cross-country vehicle and vice versa. Consequently, it is necessary to design a great number of carburetor types and to select a float chamber of appropriate dimensions for each type.

It is therefore an object of the present invention to provide a carburetor having a float chamber which permits the carburetor to be mounted on any type of engine both for passenger cars and cross-country vehicles as it does not matter how the float chamber is arranged with respect to the main conduit of the carburetor.

It is another object of the present invention to provide a carburetor having a float chamber in which the fuel level in the main well is kept at a constant level in any running condition or position of the motor vehicle.

SUMMARY OF THE INVENTION

The invention provides a carburetor for internal combustion engines of motor vehicles, having a suction conduit, a float chamber located adjacent the suction conduit, an emulsioning tube in which the fuel sucked in by the suction conduit is emulsified, a main jet for metering the fuel to be fed to the emulsioning tube, and a float member system cooperating with a needle valve arranged at the inlet of the float chamber and preferably on the carburetor cover to define a fuel level within the fuel chamber and a free space for the fuel between the inner walls of the float chamber and the outer surfaces of the float members. The improvement provided by the present invention consists in that the float chamber has a flat bottom surface, at least one flat surface defines the carburetor cover portion facing the float chamber, the float chamber has vertical side walls, and the main jet of the carburetor is located in a vertical plane passing through the center of gravity of a plane figure formed by sectioning said free space by the plane of the fuel level in the float chamber when the carburetor is in a horizontal position.

BRIEF DESCRIPTION OF THE DRAWINGS

FIG. 1 is a top plan view of a carburetor according to the invention with a float chamber shown in open condition;

FIG. 2 shows the fuel chamber in the direction of the arrow D in FIG. 1;

DESCRIPTION OF PREFERRED EMBODIMENT

Figure 3:
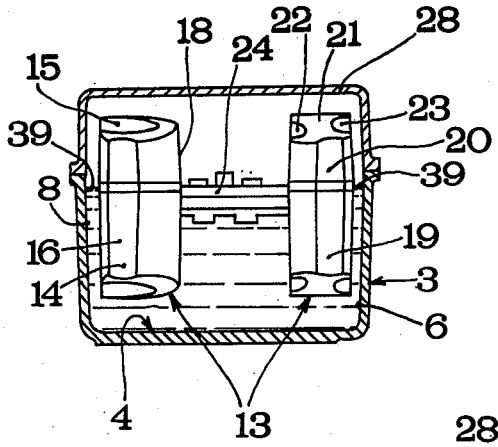
FIG. 3 shows the fuel chamber in the direction of the arrow M in FIG. 1.

A carburetor as shown in FIGS. 1 through 5 comprises a main conduit 1, a diffusor cone 2 and an air inlet 29 located upstream of the diffusor cone 2. The conventional throttle valve is not shown in the drawings as it does not relate to the present invention. The shaft of the throttle valve extends parallel to the longitudinal axis of the engine to ensure appropriate distribution of the fuel mixture supplied by the carburetor when the engine is idling or running at low power.

Figure 5:
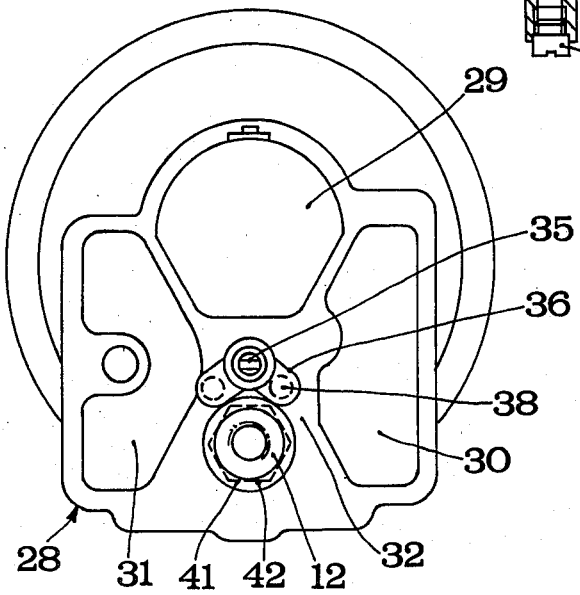
FIG. 5 is a plan view of the carburetor cover of FIG. 4.

The carburetor further comprises a float chamber 3 located adjacent the main conduit 1 and having a flat bottom 4 and four accurately vertical side walls 5, 6, 7 and 8. At its top the chamber is closed by a cover 28 as shown in FIG. 5. The geometrical configuration of the cover 28 in the portion facing the float chamber 3 is an exact reproduction of the geometrical configuration of the latter. This portion essentially comprises a pair of recesses 30 and 31 divided by a separating member 32. The surfaces delimiting the recesses 30 and 31 upwardly are flat and the surface delimiting downwardly the separating member 32 is also flat. The side walls of the recesses 30 and 31 are exactly vertical.

Three columns 9, 10 and 11 are arranged within the float chamber 3 and respectively constitute two accommodating elements for connecting members of parts of the carburetor and a portion of a conduit for the primary mixture to be fed to the main conduit 1 in particular operating conditions of the engine which do not concern the present invention. These columns are essentially hollow cylinders, whose outer surfaces are partially immerged in the space of the chamber 3, and are formed integrally with the walls thereof. The arrangement of these columns in the chamber 3 is determined by spatial and operational requirements of the carburetor, but does not disturb the correct operation of the carburetor in various running conditions and positions of the motor vehicle on which the carburetor is mounted, as they have vertical outer walls, which constitutes an advantage as will be explained hereinafter.

Arranged within the chamber 3 is a float member system 13 formed by a pair of floats 14 and 19. The float 14 has a pair of lobes 16 and 17, a first recess 15 partially surrounding the column 9 without being in contact therewith, and an arcuate back portion 18. The other float 19 has a pair of lobes 20 and 21, a second recess 22 partially surrounding the column 10 without being in contact therewith, and a third recess 23 to compensate for the presence of the first recess 15 in the float 14. The depth of the floats on the side of the lobes 16 and 20 is considerably lower than the depth of the floats on the side of the lobes 17 and 21. This float system 13 controls a needle valve 12 by means of a lever 25 secured to a web 24 connecting the two floats. The lever 25 rotates about a conventional pivot, not shown, contained in a support member 26 for the lever 25. The two lobes 17 and 21 of the floats 14 and 19, respectively, are located near the fulcrum of the lever 25 in the support member 26 and the lobes 16 and 20 are located further away from this fulcrum.

As shown in FIG. 1, the float system 13 cooperates with the chamber 3 to form a plane figure 39 obtained by sectioning in a horizontal plane the solid figure defined by the four walls 5, 6, 7 and 8 of the chamber 3, by the outer side surfaces of the three columns 9, 10 and 11 and the outer surfaces of the two floats 14 and 19, selecting a plane of sectioning near the plane of the fuel level during operation of the carburetor. The center of gravity 33 of the plane figure 39 is located in the area 34 between the floats 14 and 19. A main jet 35 of the carburetor is located in a vertical plane passing through the center of gravity 33 of the figure 39.

Figure 4:
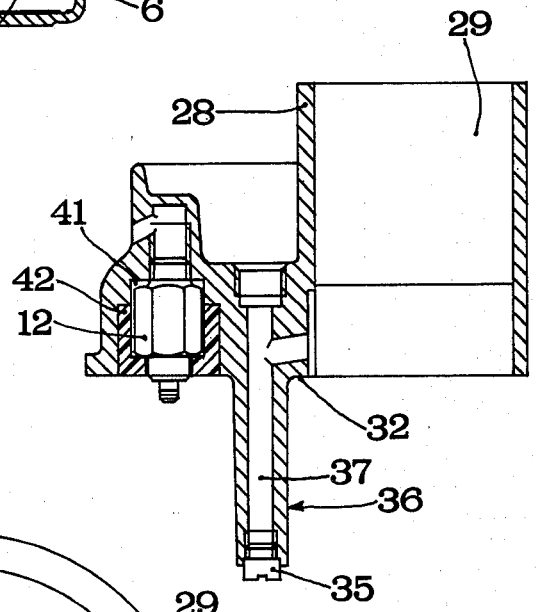
FIG. 4 is a sectional view of a carburetor cover according to the invention.

As shown in FIGS. 4 and 5, the main jet 35 is arranged at the bottom of a columnar structure 36 wherein is provided a housing 37 for the emulsioning tube and part of the idling circuits 38. The outer walls of the columnar structure 36, suspended from the cover of the carburetor to improve the behavior thereof with respect to the effects of the heat on the fuel in the chamber 3, are vertical as shown in FIG. 4. When the carburetor is mounted on the engine, the columnar structure 36 is located in the area 34 of the chamber 3 between the two floats 14 and 19 to support the main jet 35 in a vertical plane including the center of gravity of the figure 39 as mentioned previously.

The behavior of the illustrated carburetor is such as to solve the problems resulting from different running conditions and positions of the motor vehicle on which it is mounted. In particular, it permits to maintain the fuel level in the emulsioning tube contained in the housing 37 constant even if the motor vehicle is submitted to heavy accelerations in the transverse or longitudinal direction, or when it is running uphill or downhill on slopes having an inclination of more than 100%, or on uneven ground of about the same inclination transversely of the traveling direction of the motor vehicle as may happen with cross-country vehicles traveling on very uneven ground. This is because the main jet 35 and the emulsioning tube contained within the housing 37 are located in the center of gravity and is due to the resulting behavior of the floats 14 and 19 in the various inclined positions of the carburetor. In fact, the floats 14 and 19 produce by hydrostatic pressure a torque on the fulcrum 26 of the lever 27 to keep the needle valve 12 at a substantially constant degree of closure at all inclinations of the carburetor. This is due to the geometric configuration of the floats 14 and 19, which causes the lobes 17 and 21 to be more deeply immerged in the liquid than the lobes 16 and 20. The more deeply immerged lobes produce a greater hydrostatic pressure, but as these lobes are closer to the fulcrum 26, the torque produced by this pressure is about the same as the torque produced by the pressure of the less deeply immerged lobes which are more distant from the fulcrum. The configuration of the floats 14 and 19 is such as to keep the static moment constant relative to the fulcrum 26 of the figures resulting from sectioning the floats in the plane of the fuel level in the chamber 3, independently of the inclination of the carburetor. With this geometric configuration it is possible to keep the closing torque of the needle valve 12 constant irrespective of the inclination of the carburetor.

USEFULNESS OF THE INVENTION

From the foregoing explanations it will be evident that a carburetor having a float chamber and a float system as described above, with the main jet located vertically in the center of gravity, does not have to be arranged with the float chamber in one of the conventional positions relative to the main conduit 1 of the carburetor and can be mounted on all engines independently of whether they are arranged longitudinally or transversely of the motor vehicle or on cross-country vehicles. This has also been confirmed by a series of tests and the theoretical justification given above for the configuration of the described elements.

A further problem solved by the provision of the described carburetor consists in that it permits to keep the volume of the fuel within the float chamber 3 constant in different inclinations of the carburetor. This problem is solved by the geometric configuration of the floats 14 and 19, described above, which keeps their closing effect on the needle valve 12 constant with varying inclinations of the carburetor. However, to solve this problem it is also necessary for the center of gravity 33 of the figure 39 to remain a center of gravity of any other plane figure produced by the intersection of a plane including the point 33 by the spatial figure described above and inclined relative to the horizontal plane. This is in fact the case with the described geometrical configuration as the parallelism of the surfaces surrounding the chamber 3, which extend all vertically, ensures homeographic conformity among all figures produced by intersection of planes passing through the center of gravity 33 and inclined relative to said spatial figure.

From the operational point of view this can be checked by ascertaining whether the hydrostatic head of the carburetor in the emulsioning tube is correct when the carburetor is inclined in any desired position, as described above, and whether the hydrostatic head of the carburetor does not change when the carburetor returns abruptly to the horizontal position. Or, vice versa, this can be checked by ascertaining whether the hydrostatic head of the carburetor is correct with the carburetor in the horizontal position and whether the hydrostatic head of the carburetor remains unchanged when the carburetor is brought abruptly into an inclined position. This is in effect the case with the carburetor according to the invention, even with inclinations of more than 100% (45°).

The provision of plane surfaces such as the bottom 4 of the chamber 3 and the upper surfaces of the recesses 30 and 31 or the lower surface of the separating area 32, which surfaces delimit the chamber 3 upwardly and downwardly, ensures the maintenance of a homeographic conformity also between plane figures which are generated by planes and have an inclination that permits their incidence on the planes of the bottom 4, recesses 30 and 31 and separating area 32. For these reasons the carburetor maintains substantially the same volume of fuel in the float chamber in all running conditions and positions of the motor vehicle.

To avoid the formation of lost volumes which would conflict with the foregoing statements by producing volumes that are variable with the variation of the inclination of the carburetor with a resulting undesired variation of the hydrostatic head in the emulsioning tube, a sleeve 42 is provided in the seat 41 of the needle valve 12 to keep the separating area 32 coplanar with the recesses 30 and 31, as shown in FIGS. 4 and 5.

Although a preferred embodiment of the invention has thus been described in detail and illustrated in the accompanying drawings, it is to be understood that the invention is not limited to this precise embodiment and that numerous changes and modifications obvious to one skilled in the art, particularly with regard to the shape and dimensions of the elements and the type of materials used, may be made therein without departing from the scope of the invention as defined by the appended claims. More particularly, it is not strictly necessary to arrange the float chamber 3 with respect to the main conduit 1 exactly in the position as shown in FIG. 1; rather, the float chamber 3 may also be arranged laterally or rearwardly of the main conduit 1 contrary to the practice in conventional carburetors in which the float chamber is necessarily located in front of the main conduit 1 in the traveling direction of the vehicle.

We claim:

1. A carburetor for internal combustion engines of motor vehicles, comprising a suction conduit;

a float chamber located adjacent said suction conduit;

an emulsioning tube for emulsifying therein the fuel sucked in by said suction conduit;

a main jet for metering the fuel to be fed to said emulsioning tube;

a float member system cooperating with a needle valve arranged at an inlet of said float chamber to define a fuel level within said float chamber and a free space for the fuel between the inner walls of said float chamber and outer surfaces of said float members;

said float chamber having a flat bottom surface and vertical side walls and at least one flat surface defines a portion of a carburetor cover facing said float chamber and said main jet of the carburetor is located in a vertical plane passing through the center of gravity of a plane figure formed by sectioning said free space by the plane of the fuel level in said float chamber when the carburetor is in a horizontal position;

at least two of said vertical side walls of said float chamber being formed integrally with part cylindrical hollow columns projecting inwardly from said vertical side walls and each of said float members having at least one substantially vertically extending hollow surface matching the outer surface of said part cylindrical hollow columns so that said float members are to a limited extent movable in said float chamber with a substantially vertical angular movement before said substantially vertically extending hollow surfaces engage said part cylindrical hollow columns to be arrested thereby.

2. A carburetor as claimed in claim 1, wherein a first one of said vertical side walls of said float chamber is formed integrally with a first part cylindrical hollow column projecting inwardly from an adjacent one of said vertical side walls, a second one of said vertical side walls of said float chamber is formed integrally with a second part cylindrical hollow column projecting inwardly from an inwardly extending portion of said second vertical side wall, said second vertical side wall being adjacent to said first vertical side wall, said second part cylindrical hollow column being located in an intermediate position between said first part cylindrical hollow column and an opposite one of said vertical side walls of said float chamber and being spaced from said opposite one of said vertical side walls by a distance greater than the spacing of said first part cylindrical hollow column from said adjacent one of said vertical side walls;

said float member system comprising a first float member having a substantially vertically extending hollow surface matching the outer surface of said first part cylindrical hollow column and spaced therefrom by a distance permitting limited substantially vertical angular movement of said first float member relative to said first part cylindrical hollow column, and a second float member having an inner surface provided with second substantially vertically extending hollow surface matching the outer surface of said second part cylindrical hollow column and spaced therefrom by a distance permitting limited substantially vertical angular movement of said second float member relative to said second part cylindrical hollow column, said second float member having an outer surface provided with a third substantially vertically extending hollow surface, each of said first, second and third substantially vertically extending hollow surfaces defining a recess and the volume of said recess defined by said first substantially vertically extending hollow surface being substantially the same as the volume of said recesses defined by said second and third substantially vertically extending hollow surfaces taken together.

3. A carburetor as claimed in claim 2, wherein a third part cylindrical hollow column of smaller diameter than said first and second part cylindrical hollow columns is located in an intermediate position between said first and second part cylindrical hollow columns and is formed integrally with said second one of said vertical side walls of said float chamber in a position spaced from said second part cylindrical hollow column.

* * * * *